United States Patent [19]

Chen

[11] Patent Number: 5,020,792

[45] Date of Patent: Jun. 4, 1991

[54] EXERCISE BICYCLE FOR EXERCISING ARMS AND LEGS

[76] Inventor: T. C. Chen, No. 89, Lane 465, Lien-Tsun Rd., Feng-Yuan City, Taiwan

[21] Appl. No.: 497,429

[22] Filed: Mar. 22, 1990

[51] Int. Cl.[5] ..... A63B 21/00

[52] U.S. Cl. ..... 272/72; 272/72

[58] Field of Search ..... 272/71, 72, 73, 71, 272/132, 128, 130; 128/25 R

[56] References Cited

U.S. PATENT DOCUMENTS

| | | | |
|---|---|---|---|
| 4,789,153 | 12/1988 | Brown | 272/72 |
| 4,850,587 | 7/1989 | Lin | 272/72 |
| 4,953,850 | 9/1990 | Lo | 272/73 |

*Primary Examiner*—Stephen R. Crow
*Attorney, Agent, or Firm*—Pasquale A. Razzano

[57] ABSTRACT

An exercise bicycle includes an elongated base frame, two support frames mounted on the front portion of the base frame and an adjustable seat mounted on the rear portion of the base frame. A driving assembly, a hand operated assembly, a transmission assembly and a load applying assembly are mounted to the support frames in a compact manner. The driving assembly has a first wheel and a second wheel rotated with the first wheel. The hand operated assembly has a third wheel with a peripheral groove mounted to the second shaft, a rope member wound around the third wheel in the peripheral groove. The transmission assembly has a fourth wheel and a fifth wheel rotated with the fourth wheel. The load applying assembly has a sixth wheel and a seventh wheel rotated with the sixth wheel. A damping fan is coaxially connected to the seventh wheel. When the user pedals and thus rotates the first wheel in a predetermined direction, the second, fourth, fifth, sixth, and seventh wheels and the damping fan are in turn rotated in the predetermined direction; and when the rope member is pulled toward the seat by the user, the third, forth, fifth, sixth, and seventh wheels and the damping fan are in turn rotated in the predetermined direction.

1 Claim, 2 Drawing Sheets

EXERCISE BICYCLE FOR EXERCISING ARMS AND LEGS

BACKGROUND OF THE INVENTION

This invention relates to an exercise bicycle, more particularly to an exercise bicycle designed for exercising the arms and legs.

Although many types of exercise bicycles have been developed and used for exercising the arms and legs of the user, in most cases, the structures of them are complicated and they are bulky and cumbersome.

SUMMARY OF THE INVENTION

It is therefore a main object of this invention to provide an exercise bicycle for exercising the arms and legs of the user which is simple in structure and small in size.

Accordingly an exercise bicycle of this invention includes an elongated base frame having two support frames respectively mounted on two sides of the front portion thereof and an adjustable seat mounted to the rear portion thereof, the two support frames having a first, second and third shaft transversely journalled therebetween, the first shaft having two crank arms respectively connected to two ends thereof and two pedals secured to the crank arms respectively;

a driving assembly including a first wheel mounted to the first shaft, a first one-way bearing provided between the first wheel and the first shaft so that said first wheel is rotated in a predetermined direction by the first shaft when the first shaft is rotated by the pedals in said predetermined direction but not rotated by the first shaft when the first shaft is rotated in an opposite direction relative to said predetermined direction, a second wheel fixed to the second shaft, and a first flexible element trained on the first wheel and the second wheel so that said second wheel can be driven by said first wheel, the diameter of the second wheel being smaller than that of the first wheel;

a hand operated assembly including a third wheel with a peripheral groove mounted to the second shaft, a rope member wound around the third wheel in the peripheral groove, the rope member connected to the third wheel at one end thereof and connected to a handle at the other end thereof, the third wheel being rotated in the predetermined direction when a user pulls the handle toward the seat and pulls the rope member out of the peripheral groove of the third wheel, a return spring connected to the third wheel at one end thereof and the front portion of the base frame at the other end thereof, forcing the third wheel to be rotated in the opposite direction so that the rope member can be rewound onto the third wheel after being pulled out, a second one-way bearing being provided between the third wheel and the second shaft so that the second shaft can be rotated by the third wheel in the predetermined direction when the third wheel is rotated by pulling the rope member out of the peripheral groove of the third wheel but not rotated with the third wheel when the third wheel is rotated by the return spring in the opposite direction;

a transmission assembly including a fourth wheel fixed to the second shaft and coaxially rotated with the second wheel, a fifth wheel fixed to the third shaft, and a second flexible element trained on the fourth and fifth wheels so that the fifth wheel can be rotated with the fourth wheel, the diameter of the fifth wheel being smaller than that of the fourth wheel; and a load applying assembly including a sixth wheel fixed to the third shaft and coaxially rotated with the fifth wheel, a seventh wheel journalled on the first shaft, and a third flexible element trained on the sixth and the seventh wheels so that the seventh wheel can be rotated with the sixth wheel, the seventh wheel having a damping fan coaxially connected thereto and journalled on the first shaft. The diameter of the seventh wheel is smaller than that of the sixth wheel.

Whereby, when the pedals are rotated in the predetermined direction, the first, second, fourth, fifth, sixth, and seventh wheels and the damping fan are in turn rotated in the predetermined direction; and when the handle is pulled toward the seat by the user, the third, forth, fifth, sixth, and seventh wheels and the damping fan are in turn rotated in the predetermined direction.

Most of the parts of the exercise bicycle of this invention are installed between the support frames at the front portion of the exercise bicycle in a compact manner, largely reducing the size of the exercise bicycle. In addition, the structure of the exercise bicycle is simple, and facilitates exercising the arms and legs at the same time.

BRIEF DESCRIPTION OF THE DRAWINGS

Other features and advantages of this invention will become apparent in the following detailed description of a preferred embodiment of this invention with reference to the accompanying drawings, in which.

DETAILED DESCRIPTION OF THE PREFERRED EMBODIMENTS

Figure 1:
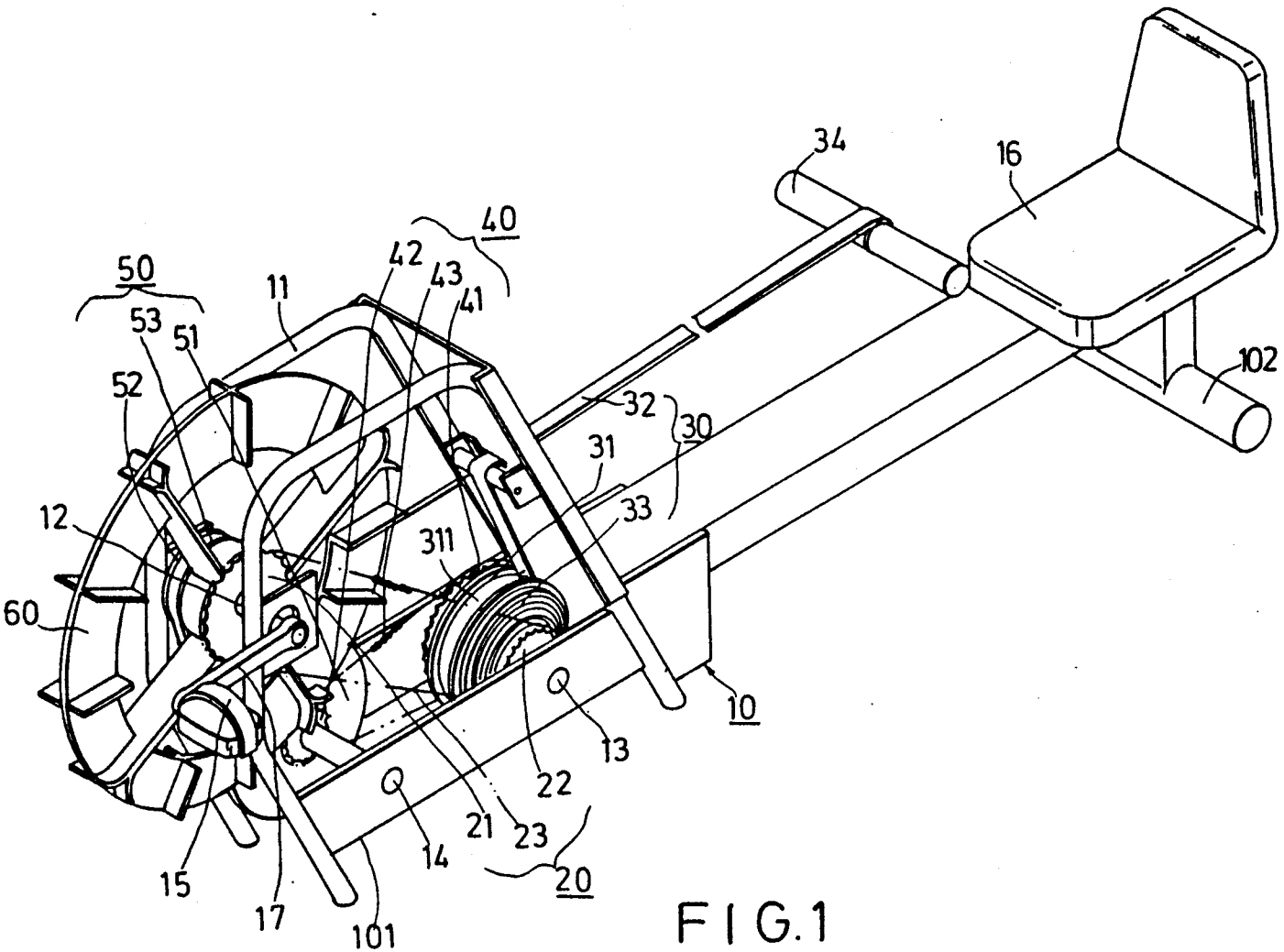
FIG. 1 is a perspective view of a preferred embodiment of an exercise bicycle of this invention.
Figure 2:
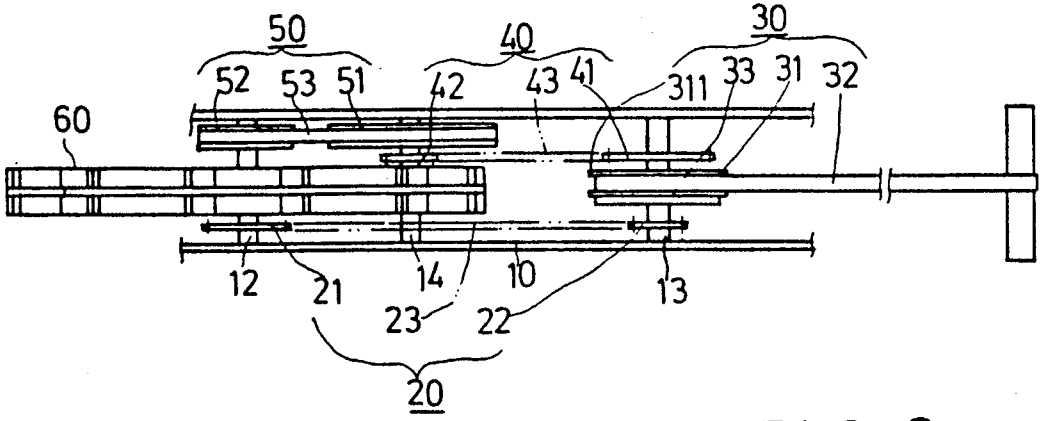
FIG. 2 is a top view of the preferred embodiment of the exercise bicycle of this invention.
Figure 3:
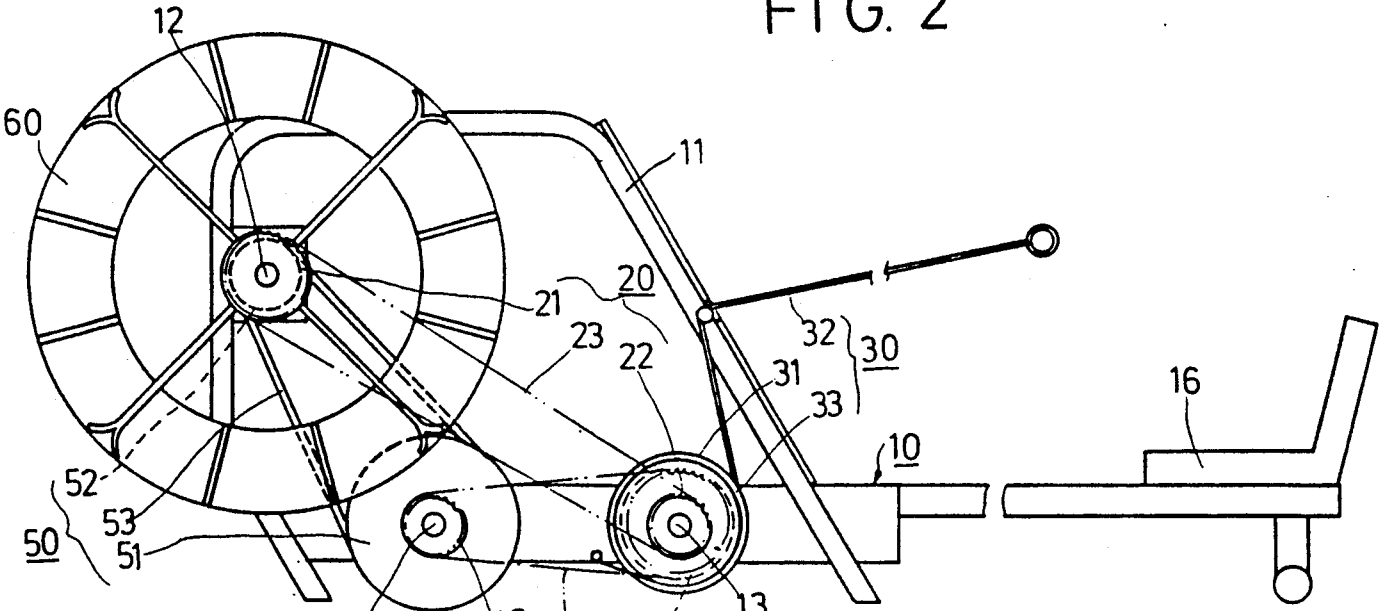
FIG. 3 is a schematic side view of the preferred embodiment of the exercise bicycle of this invention.

Referring to the drawings, a preferred embodiment of an exercise bicycle of this invention includes an elongated base frame 10, a driving assembly 20, a hand operated assembly 30, a transmission assembly 40, and a load applying assembly 50.

The elongated base frame 10 has two inverted U-shaped support frames 11 respectively mounted on two sides of the front portion 101 of the elongated frame 10 and an adjustable seat 16 mounted to the rear portion 102 of the elongated base frame 10. The two support frames have a first, second and third shaft 12, 13, 14 transversely journalled therebetween. The first shaft 11 has two crank arms 17 (the one on the other side of the base frame is not shown) respectively connected to two ends thereof and two pedals 15 secured to the crank 17 arms respectively.

The driving assembly 20 is comprised of a first wheel 21 mounted to the first shaft 12, a second wheel 22 fixed to the second shaft 13, and a first flexible element 23 trained on the first wheel 21 and the second wheel 22 so that said second wheel 22 can be driven by said first wheel 21. In the preferred embodiment, the first and second wheels 21, 22 are sprocket wheels and the first flexible element 23 is a sprocket chain, while the first and second wheels 21, 22 may be pulleys and the first flexible element may be a belt. The pitch diameter of the second wheel 22 is smaller than that of the first wheel 21. A first one-way bearing (not shown) is provided between the first wheel 21 and the first shaft 12 so that said first wheel 21 is rotated in a predetermined direction; counterclockwise for example, by the first shaft 12 when said first shaft 12 is rotated counterclockwise by the pedals 15, but not rotated with said first shaft 12 when said first shaft 12 is rotated clockwise.

The hand operated assembly 30 includes a third wheel 31 with a peripheral groove 311 mounted to the second shaft 13, and a rope member 32, such as a steel rope, wound around the third wheel 31 in the peripheral groove 311. The rope member 32 is connected to the third wheel 31 at one end thereof and connected to a handle 34 at the other end thereof. The third wheel 31 is rotated counterclockwise when a user pulls the handle 34 toward the seat 16 and thus pulls the rope member 32 out of the peripheral groove 311 of the third wheel 31. A spiral return spring 33 is connected to the third wheel 31 at one end thereof and the front portion 101 of the base frame 10 at the other end thereof, forcing the third wheel 31 to be rotated clockwise so that the rope member can be rewound onto the third wheel after being pulled out. A second one-way bearing (not shown) is provided between the third wheel 31 and the second shaft 13 so that said second shaft 13 can be rotated counterclockwise by the third wheel 31 when said third wheel 31 is rotated by pulling the rope member 32 out of the peripheral groove 311 of the third wheel 311, but not rotated with the third wheel 31 when the third wheel 31 is rotated clockwise by the return spring 33.

The transmission assembly 40 includes a fourth wheel 41 fixed to the second shaft 13 and coaxially rotated with the second wheel 22, a fifth wheel 42 fixed to the third shaft 14, and a second flexible element 43 trained on the fourth and fifth wheels 41, 42 so that said fifth wheel 42 can be rotated with the fourth wheel 41. In the preferred embodiment, the fourth and fifth wheels 41, 42 are sprocket wheels and the second flexible element 43 is a sprocket chain. The pitch diameter of the fifth wheel 42 is smaller than that of the fourth wheel 41.

The load applying assembly 50 includes a sixth wheel 51 fixed to the third shaft 14 and coaxially rotated with the fifth wheel 42, a seventh wheel 52 journalled on the first shaft 12 by a bearing (not shown), and a third flexible element 53 trained on the sixth and the seventh wheels 51, 52 so that said seventh wheel 52 can be rotated with said sixth wheel 51. The seventh wheel 52 has a damping fan 60 coaxially connected thereto and journalled on the first shaft 12. The damping fan 60 is used as a load when it is rotated by the user. In the preferred embodiment, the sixth and seventh wheels 51, 52 are pulleys and the third flexible element 53 is a belt. The pitch diameter of the seventh wheel 52 is smaller than that of the sixth wheel 51.

In operation, when the user pedals the first shaft 12 to rotate counterclockwise, the first, second, fourth, fifth, sixth, and seventh wheels 21, 22, 41, 42, 51, 52 and the damping fan 60 are in turn rotated counterclockwise. In this way, the damping fan 60 can apply a load, thus allowing the user to exercise his/her legs. The third wheel 31 is not rotated by the second shaft 13 during the abovementioned operations. However, the user, whether pedaling or not, can pull the handle 34 and the rope member 32 out of the peripheral groove 311 of the third wheel 31 against the action of the return spring 33 and rotate said second shaft 13 counterclockwise. In this way, the forth, fifth, sixth, and seventh wheels 41, 42, 51, 52 and the damping fan 60 are in turn rotated counterclockwise, so that said damping fan 60 can apply a load to the arms of the user for exercising purposes.

It is noted that because the pitch diameters of the second, the fifth, and the seventh wheels 22, 42, 52 are respectively smaller than those of the first, the fourth and the sixth wheels 21, 41, 51, the exercise bicycle of this invention is operated with three speed-changing stages. Therefore, the exercise bicycle can apply a variable load to the user. Most of the parts of the exercise bicycle of this invention are installed between the support frames 11 at the front portion 101 of the exercise bicycle in a compact manner, greatly reducing the size of the exercise bicycle. In addition, the structure of the exercise bicycle is simple and facilitates exercising of the arms and legs at the same time.

With this invention thus explained, it is apparent that numerous modifications and variations can be made without departing from the scope and spirit of this invention. It is therefore intended that this invention be limited only as indicated in the appended claims.

I claim:

1. An exercise bicycle comprising:

an elongated base frame having a front portion and a rear portion, said front portion of said elongated base frame having two support frames respectively mounted on two sides thereof, said rear portion of said elongated base frame having an adjustable seat mounted thereto, said two support frames having a first, second and third shaft transversely journalled therebetween, said first shaft having two crank arms respectively connected to two ends thereof and two pedals secured to said crank arms respectively;

a driving assembly including a first wheel mounted to said first shaft, a first one-way bearing provided between said first wheel and said first shaft so that said first wheel is rotated in a predetermined direction by said first shaft when said first shaft is rotated by said pedals in said predetermined direction but not rotated by said first shaft when said first shaft is rotated in an opposite direction relative to said predetermined direction, a second wheel fixed to said second shaft, and a first flexible element trained on said first wheel and said second wheel so that said second wheel can be driven by said first wheel, the diameter of said second wheel being smaller than that of said first wheel;

a hand operated assembly including a third wheel with a peripheral groove mounted to said second shaft, a rope member wound around said third wheel in said peripheral groove, said rope member connected to said third wheel at one end thereof and connected to a handle at the other end thereof, said third wheel being rotated in said predetermined direction when a user pulls said handle toward said seat and thus pulls said rope member out of said peripheral groove of said third wheel, a return spring connected to said third wheel at one end thereof and said front portion of said base frame at the other end thereof, forcing said third wheel to be rotated in said opposite direction so that said rope member can be rewound onto said third wheel after being pulled out, a second one-way bearing being provided between said third wheel and said second shaft so that said second shaft can be rotated by said third wheel in said predetermined direction when said third wheel is rotated by pulling said rope member out of said peripheral groove of said third wheel but not rotated with said third wheel when said third wheel is rotated by said return spring in said opposite direction;

a transmission assembly including a fourth wheel fixed to said second shaft and coaxially rotated with said second wheel, a fifth wheel fixed to said third shaft, and a second flexible element trained on said fourth and fifth wheels so that said fifth wheel can be rotated with said fourth wheel, the diameter of said fifth wheel being smaller than that of said fourth wheel; and a load applying assembly including a sixth wheel fixed to said third shaft and coaxially rotated with said fifth wheel, a seventh wheel journalled on said first shaft, and a third flexible element trained on said sixth and said seventh wheels so that said seventh wheel can be rotated with said sixth wheel, said seventh wheel having a damping fan coaxially connected thereto and journalled on said first shaft, the diameter of said seventh wheel being smaller than that of said sixth wheel;

whereby, when said pedals are rotated in said predetermined direction, said first, second, fourth, fifth, sixth, and seventh wheels and said damping fan are in turn rotated in said predetermined direction; and when said handle is pulled toward said seat by the user, said third, forth, fifth, sixth, and seventh wheels and said damping fan are in turn rotated in said predetermined direction.

* * * * *